US007740502B2

(12) United States Patent
Blew et al.

(10) Patent No.: US 7,740,502 B2
(45) Date of Patent: Jun. 22, 2010

(54) REUSEABLE COAXIAL CONNECTORS AND RELATED METHODS

(75) Inventors: Douglas John Blew, Mooresville, NC (US); Neil P. Phillips, Dove Canyon, CA (US); Carl Meyerhoefer, Mooresville, NC (US)

(73) Assignee: CommScope, Inc. of North Carolina, Hickory, NC (US)

( * ) Notice: Subject to any disclaimer, the term of this patent is extended or adjusted under 35 U.S.C. 154(b) by 0 days.

(21) Appl. No.: 12/327,355

(22) Filed: Dec. 3, 2008

(65) Prior Publication Data

US 2009/0163075 A1 Jun. 25, 2009

Related U.S. Application Data

(60) Provisional application No. 61/016,078, filed on Dec. 21, 2007.

(51) Int. Cl.
*H01R 9/05* (2006.01)

(52) U.S. Cl. ..... 439/578; 439/583

(58) Field of Classification Search ..... 439/578, 439/583, 584, 585

See application file for complete search history.

(56) References Cited

U.S. PATENT DOCUMENTS

| | | | | |
|---|---|---|---|---|
| 3,373,243 | A | 3/1968 | Janowiak et al. | |
| 4,408,822 | A | 10/1983 | Nikitas | |
| 4,834,675 | A | 5/1989 | Samchisen | |
| 4,902,246 | A | 2/1990 | Samchisen | |
| 5,024,606 | A | 6/1991 | Ming-Hwa | |
| 5,207,602 | A | 5/1993 | McMills et al. | |
| 5,342,218 | A | 8/1994 | McMills et al. | |
| 5,470,257 | A | 11/1995 | Szegda | |
| 5,632,651 | A * | 5/1997 | Szegda | 439/578 |
| 5,651,698 | A * | 7/1997 | Locati et al. | 439/578 |
| 5,690,510 | A | 11/1997 | Chishima | |
| 5,863,220 | A | 1/1999 | Holliday | |
| 5,879,191 | A | 3/1999 | Burris | |
| 6,089,912 | A | 7/2000 | Tallis et al. | |
| 6,089,913 | A | 7/2000 | Holliday | |
| 6,159,046 | A | 12/2000 | Wong | |

(Continued)

FOREIGN PATENT DOCUMENTS

EP 1 777 783 A1 4/2007

(Continued)

OTHER PUBLICATIONS

International Search Report and Written Opinion (13 pages) corresponding to International Application No. PCT/US2008/013749; Mailing Date: Apr. 6, 2009.

*Primary Examiner*—Thanh-Tam T Le
(74) *Attorney, Agent, or Firm*—Myers Bigel Sibley & Sajovec

(57) ABSTRACT

Coaxial connectors include a connector body and an inner contact post. A compression sleeve is also provided that is configured to impart a generally circumferential compressive force to secure one or more elements of a coaxial cable between the connector body and the inner contact post when the compression sleeve is in a seated position. The compression sleeve or the connector body includes a first disengagement mechanism that is configured to assist moving the compression sleeve from the seated position to an unseated position in which at least some of the circumferential compressive force is eliminated.

14 Claims, 15 Drawing Sheets

U.S. PATENT DOCUMENTS

| | | | | |
|---|---|---|---|---|
| 6,179,656 | B1 | 1/2001 | Wong | |
| 6,241,553 | B1 | 6/2001 | Hsia | |
| 6,352,448 | B1 | 3/2002 | Holliday et al. | |
| 6,383,019 | B1 | 5/2002 | Wilk | |
| 6,558,194 | B2 | 2/2003 | Montena | |
| 6,530,807 | B2 | 3/2003 | Rodrigues et al. | |
| 6,648,683 | B2 | 11/2003 | Youtsey | |
| 6,767,247 | B2 | 7/2004 | Rodrigues et al. | |
| 6,790,083 | B1 * | 9/2004 | Chen | 439/583 |
| 6,817,896 | B2 | 9/2004 | Derenthal | |
| D505,391 | S | 5/2005 | Rodrigues et al. | |
| 7,074,081 | B2 * | 7/2006 | Hsia | 439/584 |
| 7,153,161 | B2 * | 12/2006 | Huang | 439/583 |
| 7,192,308 | B2 | 3/2007 | Rodrigues et al. | |
| 7,329,149 | B2 * | 2/2008 | Montena | 439/584 |
| 2002/0013088 | A1 | 1/2002 | Rodrigues et al. | |
| 2003/0162439 | A1 | 8/2003 | Rodrigues et al. | |
| 2005/0003705 | A1 | 1/2005 | Rodrigues et al. | |
| 2005/0136735 | A1 | 6/2005 | Rodrigues et al. | |
| 2007/0049113 | A1 | 3/2007 | Rodrigues et al. | |
| 2007/0123100 | A1 | 5/2007 | Rodrigues et al. | |
| 2008/0261445 | A1 | 10/2008 | Malloy et al. | |
| 2008/0274644 | A1 | 11/2008 | Ridrigues | |
| 2008/0311790 | A1 | 12/2008 | Malloy et al. | |

FOREIGN PATENT DOCUMENTS

| | | |
|---|---|---|
| WO | WO98/18179 | 4/1998 |
| WO | WO 99/65118 | 12/1999 |

* cited by examiner

REUSEABLE COAXIAL CONNECTORS AND RELATED METHODS

CROSS-REFERENCE TO RELATED APPLICATION

The present application claims priority to U.S. Provisional Patent Application Ser. No. 61/016,078, filed Dec. 21, 2007, the entire contents of which is incorporated by reference herein as if set forth in its entirety.

FIELD OF THE INVENTION

The present invention relates generally to communications systems and, more particularly, to connectors for coaxial cables.

BACKGROUND

Coaxial cables are a specific type of electrical cable that may be used to carry information signals such as television signals or data signals. Coaxial cables are widely used in cable television networks and to provide broadband Internet connectivity. FIGS. 1A and 1B are, respectively, a transverse cross-sectional view and a longitudinal cross-sectional view of a conventional coaxial cable 10 (FIG. 1B is taken along the cross section B-B shown in FIG. 1A). As shown in FIGS. 1A and 1B, the coaxial cable 10 has a central conductor 12 that is surrounded by a dielectric 14. A tape 16 is preferentially bonded to the dielectric 14. The central conductor 12, dielectric 14 and tape 16 comprise the core 18 of the cable. Electrical shielding wires 20 and, optionally, electrical shielding tape(s) 22 surround the cable core 18. Finally, a cable jacket 24 surrounds the electrical shielding wires 20 and electrical shielding tape(s) 22. As shown in FIG. 1B, the dielectric 14, tape 16, electrical shielding wires 20, electrical shielding tape 22 and cable jacket 24 may be cut, and the electrical shielding wires 20, electrical shielding tape 22 and cable jacket 24 may be folded back, in order to prepare the coaxial cable 10 for attachment to certain types of coaxial connectors.

Coaxial connectors are a known type of connector that may be used to connect two coaxial cables 10 or to connect a coaxial cable 10 to a device (e.g., a television, a cable modem, etc.) having a coaxial cable interface. Coaxial "F" connectors are one specific type of coaxial connector that is used to terminate a coaxial cable with a male coaxial connector.

Standards promulgated by the Society of Cable Telecommunications Engineers ("SCTE") and, more specifically, ANSI/SCTE 99 2004, specify an axial tension pull-off or retention force that a coaxial "F" connector must impart on the coaxial cable onto which it is installed. Specification of this minimum retention force ensures that the connector will resist pulling forces that may be applied to the cable during normal use such that the cable will not readily separate from the coaxial "F" connector. Other ANSI/SCTE standards specify moisture migration parameters, electrical parameters, other mechanical parameters and environmental requirements. Relevant standards documents include the ANSI/SCTE 123 2006, 99 2004, 60, 2004 and 98 2004 standards.

A number of different types of coaxial "F" connector designs are known in the art, including, but not limited to, crimped on connectors, swaged on connectors and connectors which secure the cable into the connector with compression style cable retention elements. With the crimped connector designs, typically a hexagonal-shaped tool is used to crimp a sleeve of the connector onto the coaxial cable that is to be terminated into the connector. With the swaged connector designs, the sleeve of the connector is swaged circumferentially inward so as to reduce it's inside diameter in order to exert the required retention force on the coaxial cable.

Several different coaxial "F" connector designs are currently known in the art that have compression style cable retention elements. FIGS. 19-21 depict a connector 30 according to a first of these designs. As shown in FIGS. 19-21, the connector 30 includes a tubular connector body 40, a compression sleeve 50, an inner contact post 60 and an internally threaded nut 70. A coaxial cable 10 (not shown in FIGS. 19-21) is inserted axially into the inside diameter of the tubular connector body 40 and the compression sleeve 50 (when the connector is oriented as shown in FIG. 20, the coaxial cable 10 is inserted into the right side of the connector 30). The core 18 of the coaxial cable 10 inserts axially into an inside diameter of the inner contact post 60, while the electrical shielding wires/tape 20/22 and the cable jacket 24 circumferentially surround the outer surface of inner contact post 60. The outside surface of the inner contact post 60 may include one or more serrations, teeth, lips or other structures 61. Once the cable 10 is inserted into the connector 30 as described above, a compression tool (not shown in FIGS. 19-21) is used to axially insert the compression sleeve 50 further into the tubular connector body 40. The compression sleeve 50 directly decreases the radial gap spacing between the connector body 40 and the inner contact post 60 so as to radially impart a 360-degree circumferential compression force on the electrical shielding wires/tape 20/22 and the cable jacket 24 that circumferentially surround the outer surface of inner contact post 60. This compression, in conjunction with the serrations, teeth or the like 61 on the outside surface of the inner contact post 60, result in a gripping or retention force that is applied to the coaxial cable 10 that meets SCTE requirements for connector pull-off as well as additional electrical, mechanical and environmental requirements. In addition, this gripping/retention force may also contribute toward a positive moisture seal at the cable-connector interface. An example of a prior art connector having the design of connector 30 is provided in U.S. Pat. No. 7,192,308.

FIG. 22 illustrates a second conventional compression style back-fitting coaxial "F" connector 730. As shown in FIG. 22, the connector 730 includes a tubular connector body 740, a compression sleeve 750, an inner contact post 760 and an internally threaded nut 770. The connector body 740 of connector 730 is shorter than is the connector body 40 of connector 30. Moreover, the compression sleeve 750 fits over the outside surface of the connector body 740. The compression sleeve 750 includes an annular internal element 752 that is designed to fit between the contact post 760 and the inside surface of the connector body 740 when the compression sleeve is inserted axially into its seated (i.e., fully engaged or activated) position within the connector body 740. As a result, the annular internal element 752 may directly engage the shielding wires 22 and/or jacket 24 of a cable 10 that is inserted into and over the inner contact post 760 in the same manner that the main body of compression sleeve 50 of connector 30 engages a coaxial cable as is described above with reference to FIGS. 19-21. As such, similar to the connector 30 discussed above with respect to FIGS. 19-21, this second conventional connector 730 uses a sleeve 750 to contact and engage annular internal element 752 such that annular internal element 752 directly imparts a 360-degree circumferential compression on the inner contact post 760. This 360-degree circumferential compression imparts a gripping or retention force that meets SCTE requirements for connector pull-off and provides a moisture seal. An example of a prior art connector having the design of connector 730 is provided in U.S. Pat. No. 7,182,639.

FIGS. 23 and 24 illustrate a third conventional coaxial "F" connector 830. As shown in FIGS. 23 and 24, the connector 830 once again includes a tubular connector body 840, a compression sleeve 850, an inner contact post 860 and an internally threaded nut 870. The connector 830 further includes a reinforcing shield 844 that fits over a portion of the connector body 840. As shown in FIG. 24, as in the connector 730 of FIG. 22, the compression sleeve 850 again fits over the outside diameter of the connector body 840. The outside radius of the connector body 840 may be slightly larger than the inside radius of a portion of the compression sleeve 850. A compression tool is used to force the compression sleeve 850 over the connector body 840, and in the process the connector body 840 deforms inwardly to assert a compression/retention force on the jacket 24 and electrical shielding wires/tape 20/22 of a coaxial cable 10 that is inserted into and over the inner contact post 860 in the same manner described above with reference to connector 30 of FIGS. 19-21. In this manner, the compression sleeve 850 is used to indirectly radially decrease the gap spacing between the underlying connector body 840 and the inner contact post 860. In particular, the compression sleeve 850 imparts a 360-degree circumferential compression on the tubular connector body 840 which, in turn, deforms to impart a circumferential compression on the outside components of the cable 10 and on the inner contact post 860. The resulting gripping or retention force may meet SCTE requirements for connector pull-off, and may also contribute to providing a positive moisture sealing at the cable-connector interface. An example of the prior art F-connector design of FIGS. 23-24 is provided in U.S. Pat. No. 7,255,598.

SUMMARY

Pursuant to embodiments of the present invention, coaxial connectors are provided that include a connector body and an inner contact post that is at least partly within the connector body. These connectors further include a compression element (e.g., a compression sleeve) that is configured to impart a generally circumferential compressive force to secure one or more elements of a coaxial cable (e.g., the insulating jacket and/or electrical shielding elements) between the connector body and the inner contact post when the compression element is activated (i.e., moved into its seated position). At least one of the compression element or the connector body includes a first disengagement mechanism that is configured to assist moving the compression element from the activated position to an unseated position in which at least some of the circumferential compressive force is eliminated.

In some embodiments, the first disengagement mechanism may be a first cammed surface on the connector body and a second mating cammed surface on the compression element. In other embodiments, the first disengagement mechanism may be a first surface on the connector body that is arranged in an inclined mating relationship with a second surface on the compression element. In still other embodiments, the first disengagement mechanism may be a first set of threads on a surface of the connector body and a second, mating set of threads on the compression element. In such embodiments, the first and second sets of threads may be arranged relative to each other and be formed of a composition such that the compression element may be forcibly driven axially into the connector body into the seated position without permanently deforming either the first or second sets of threads. The coaxial connector may also include a second disengagement mechanism that is configured to operate independent of the first disengagement mechanism. The second disengagement mechanism may be any of the above listed first disengagement mechanisms or some other mechanism. For example, in one specific embodiment, the first disengagement mechanism may be a first surface on the connector body that is arranged in an inclined mating relationship with a second surface on the compression element and the second disengagement mechanism may be a first set of threads on a surface of the connector body and a second, mating set of threads on the compression element.

In some embodiments, at least one of the compression element or the connector body may include at least one raised projection and the other of the compression element or the connector body may include at least one mating recess that is configured to receive a respective one of the raised projection (s). For example, the compression element may include an annular ridge and the connector body may include a mating annular groove. In such embodiments, the annular ridge may be configured to forcibly engage the annular groove when the compression element and connector body are fully seated together with a retention force that opposes axially reversing forces sufficient to meet SCTE requirements. The annular ridge may alternatively or additionally be configured to forcibly engage the annular groove when the compression element and connector body are fully seated together sufficiently to block water ingress.

In some embodiments, a bottom portion of the connector body may include an open area that is configured to receive excess end portions of electrical shielding wires of a coaxial cable that is attached to the coaxial connector when the compression element is in the seated position. The compression sleeve may be pre-mounted on the connector body in an extended, unseated position in which the connector is ready to receive a prepared end of a coaxial cable, and the compression sleeve may be configured to be moved into a seated position by axially inserting the compression element into or over the connector body, thereby securing the end of the coaxial cable to the connector.

Pursuant to further embodiments of the present invention, methods of reusing a coaxial connector that is installed on a first coaxial cable on a second coaxial cable are provided. Pursuant to these methods, a compression element of the coaxial connector is unseated from a seated position in which the compression element and connector body of the coaxial cable together impart a compressive force on the first coaxial cable. Thereafter, the first coaxial cable is removed from the coaxial connector. The second coaxial cable is then inserted within the connector body. Finally, the compression element is moved into the seated position so that the compression element and connector body together impart a compressive force on the second coaxial cable.

In these methods, the compression element may be unseated from the seated position by, for example, popping an annular ridge that is provided on one of the compression element or connector body from an annular groove that is provided on the other of the compression element or connector body. Unseating the compression element may involve rotating the compression element relative to the connector body in order to activate a disengagement mechanism that provides a mechanical advantage for unseating the compression element from the seated position.

DETAILED DESCRIPTION

Figure 1A:
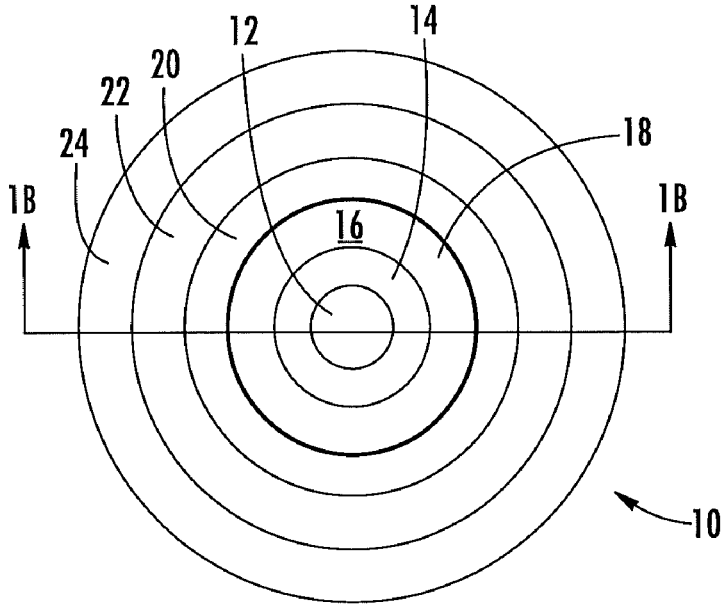
FIG. 1A PRIOR ART
FIGS. 1A and 1B are, respectively, a transverse cross-sectional diagram and a longitudinal cross-sectional diagram of a conventional coaxial cable.

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

In the drawings, the size of lines and elements may be exaggerated for clarity. It will also be understood that when an element is referred to as being "coupled" to another element, it can be coupled directly to the other element, or intervening elements may also be present. In contrast, when an element is referred to as being "directly coupled" to another element, there are no intervening elements present. Likewise, it will be understood that when an element is referred to as being "connected" or "attached" to another element, it can be directly connected or attached to the other element or intervening elements may also be present. In contrast, when an element is referred to as being "directly connected" or "directly attached" to another element, there are no intervening elements present. The terms "upwardly", "downwardly", "front", "rear" and the like are used herein for the purpose of explanation only.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. As used herein, the term "and/or" includes any and all combinations of one or more of the associated listed items.

Pursuant to embodiments of the present invention, coaxial "F" connectors with compression style back fittings are provided which include disengagement mechanisms that impart a reversible compressive, sealing and seizing force on a coaxial cable. As such, the coaxial "F" connectors according to embodiments of the present invention can be removed from a coaxial cable and thereafter reused. These connectors may use one or more of a variety of different disengagement mechanisms such as, for example, opposing cammed surfaces, opposing surfaces having an inclined mating relationship, surfaces having mating sets of threads, etc. The above-described prior art connectors impart an irreversible compressive force on the coaxial cable and, as such, these connectors could only be applied and used once. The reusable coaxial "F" connectors according to embodiments of the present invention may be implemented with respect to, for example, all three types of prior art compression style back fitting coaxial "F" connectors described in the background section above. While the connectors according to embodiments of the present invention may be reused a reasonable number of times, with some embodiments, incremental wear may occur that may eventually render the connector unusable after a certain number of uses.

Figure 2:
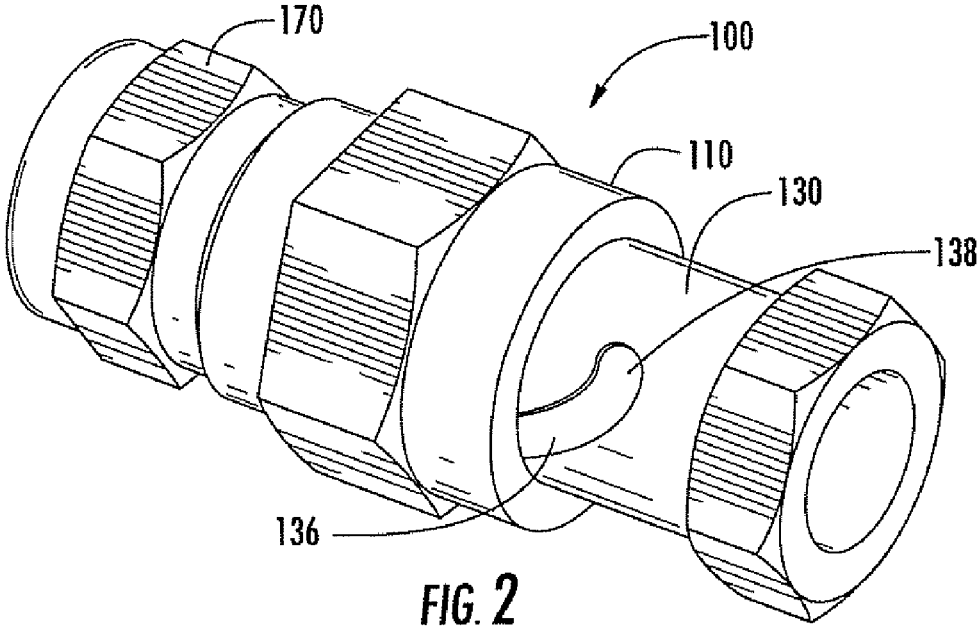
FIG. 2 is a perspective view of a coaxial "F" according to certain embodiments of the present invention.

FIG. 2 is a perspective view of a coaxial "F" connector 100 according to first embodiments of the present invention. FIG.

Figure 4:
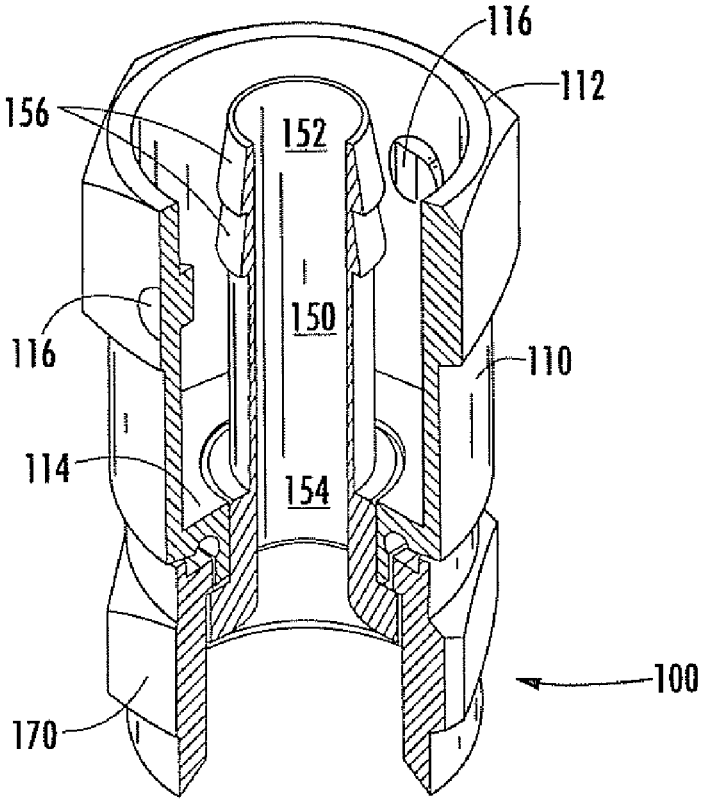
FIG. 4 is a cut-away perspective view of several of the components of the coaxial "F" connector of FIG. 2.
Figure 5A:
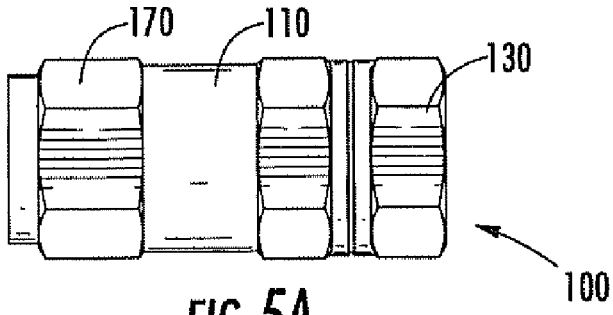
FIGS. 5A-5C are side views of the coaxial "F" connector of FIG. 2 in various states of assembly.
Figure 5B:
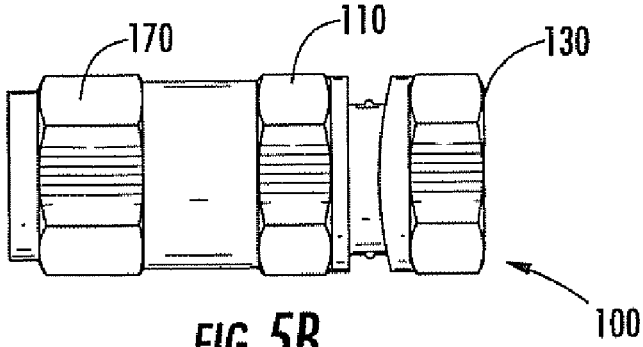
Figure 5C:
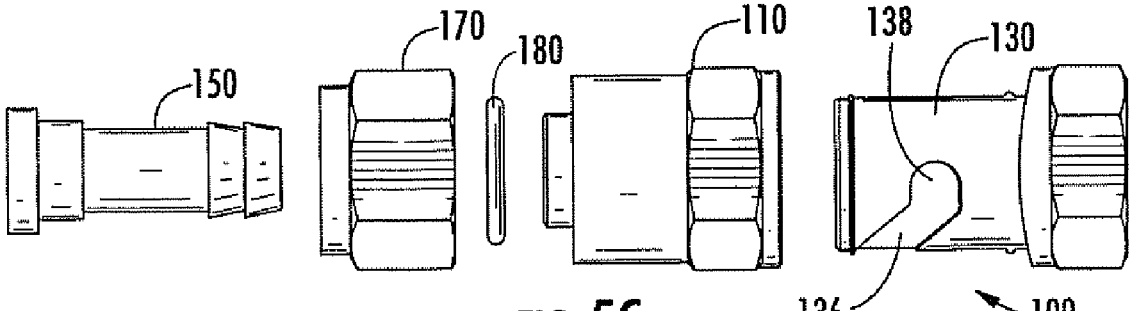
Figure 6:
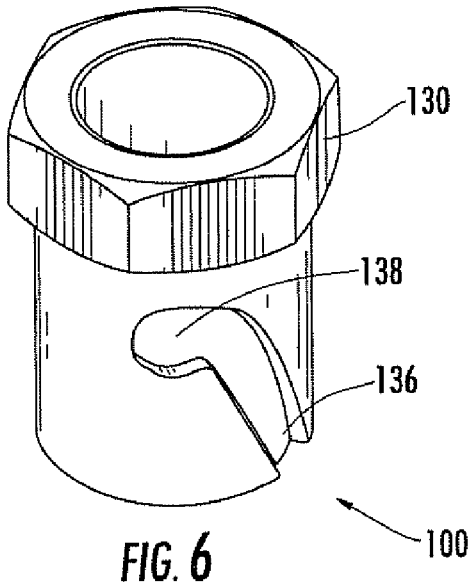
FIG. 6 is a perspective view that illustrates one of two horizontal grooves in the compression sleeve of the connector of FIG. 2.

3 is an exploded perspective view of the coaxial "F" connector 100. FIG. 4 is a cut-away perspective view of several of the components of the connector 100 of FIG. 2. FIGS. 5A-5C are side views of the connector 100 in various states of assembly. FIG. 6 is a perspective view that illustrates one of two horizontal grooves 138 in a compression sleeve of connector 100.

Figure 3:
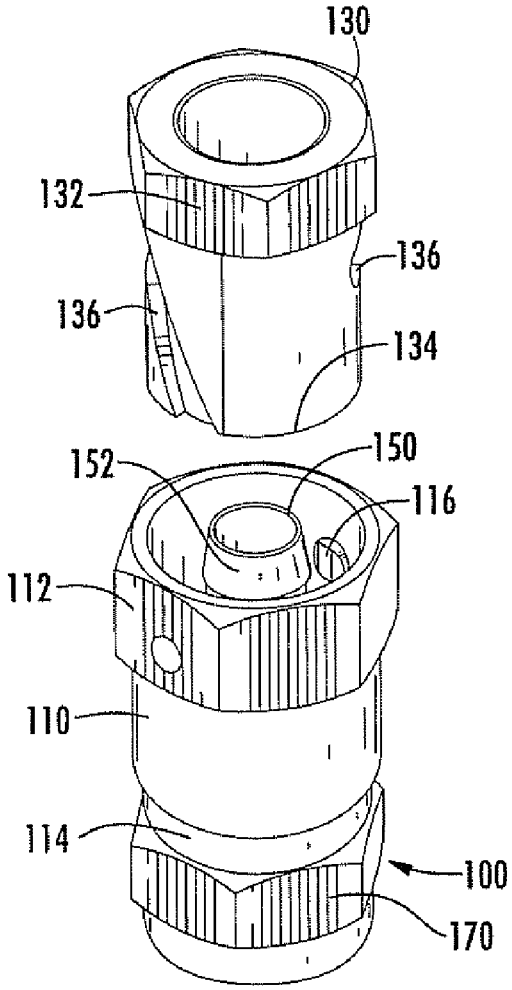
FIG. 3 is an exploded perspective view of a coaxial "F" of FIG. 2.

As shown in FIGS. 2, 3, 4, 5A-5C and 6, the connector 100 includes a tubular connector body 110, a compression sleeve 130, an inner contact post 150 and an internally threaded nut 170. As shown in FIGS. 3 and 4, the connector body 110 includes a top end 112 and a bottom end 114. The connector body 110 further includes a pair of guide pins 116 on an interior surface thereof (see FIG. 4). The compression sleeve 130 likewise includes a top end 132 and a bottom end 134. As shown in FIGS. 2 and 3, the compression sleeve 130 further includes a pair of elongated helical grooves or threads 136. These helical grooves 136 terminate into horizontal grooves 138 near the middle or top end 132 of compression sleeve 130. Each guide pin 116 on the connector body 110 travels in a respective one of these helical grooves 136 and corresponding horizontal groove 138 when the compression sleeve 130 is axially inserted into the inside diameter of the connector body 110. When inserted into the connector body 110, the compression sleeve 130 circumferentially surrounds an upper portion 152 of the inner contact post 150. As will be clear from the discussion below, the guide pins 116 and the grooves 136, 138 act as a disengagement mechanism that allows the connector 100 to be removed from a coaxial cable that it has been previously installed on and thereafter reused on another coaxial cable.

FIGS. 5A-5C illustrate the connector 100 in various states of assembly. In FIGS. 5A-5C, the cable 10 has been omitted in order to simplify the drawings (the cable 10 is included in FIG. 16B, which illustrates another embodiment of the present invention; the cable 10 illustrated in FIG. 16B would fit within the other connectors such as connector 100 described herein in a similar fashion). FIG. 5A illustrates how the connector appears once the compression sleeve 130 has been inserted into the connector body 110 in order to lock the cable 10 into place. FIG. 5B illustrates how the connector appears before it is terminated onto a cable. While not visible in FIGS. 5A-5C, the connector body 110 may include grooves or recesses and the compression sleeve 130 may include detents or other raised surfaces that mate with the grooves in order to hold the compression sleeve 130 in place within the connector body 110 as shown in FIG. 5B. As a result, the connector 100 may readily be maintained as a single piece unit until such time as a cable 10 is to be attached to the connector 100. The mating raised surfaces/recesses may be designed to only apply a small retention force so that the compression sleeve 130 may be readily moved into the position of FIG. 5A when terminating a cable 10 with the connector 100. FIG. 5C is an exploded side view of the connector 100 which more clearly shows the alignment of the inner contact post 150, the internally threaded nut 170, the connector body 110 and the compression sleeve 130. As is also shown in FIG. 5C, an optional O-ring or other type of seal 180 may be provided to enhance the moisture seal.

Figure 1B:
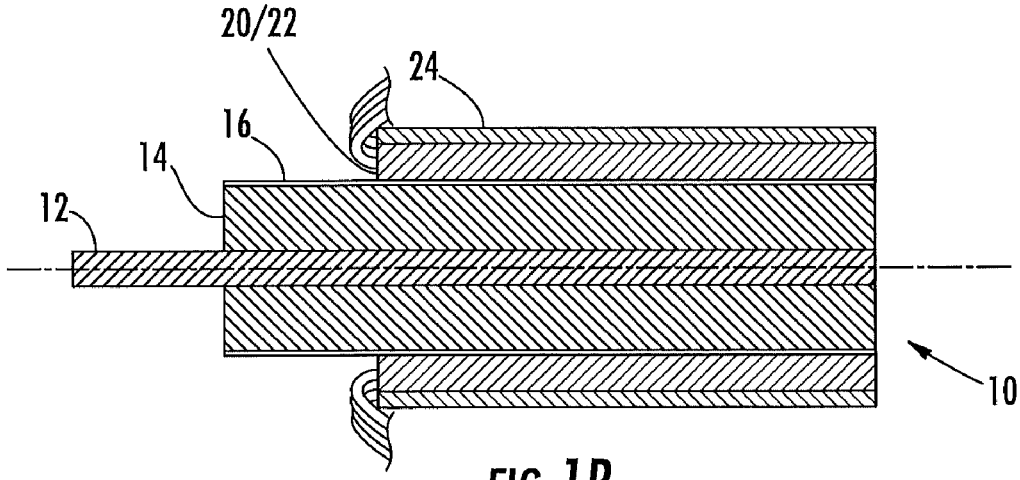
FIG. 1B PRIOR ART

In order to terminate the connector 100 onto the end of a coaxial cable 10, the cable 10 is first prepared as shown in FIG. 1B and then axially inserted into the compression sleeve 130. The core 18 of the cable 10 is axially inserted within the inner diameter of the inner contact post 150, and the electrical shielding wires/tape 20/22 and the cable jacket 24 are inserted over the outside surface of the inner contact post 150. During this insertion process, the connector 100 may be in the assembly state shown in FIG. 5B. Next, a compression tool may be used to fully insert the compression sleeve 130 into the connector body 110 so that the connector assumes the position of FIG. 5A. During this insertion process, the compression sleeve 130 rotates as the guide pins 116 travel in the helical grooves 136 and the horizontal grooves 138 of the compression sleeve 130. The inner diameter of the upper end 132 of the compression sleeve 130 may have a smaller radius than the inner diameter of the lower end 134 of the compression sleeve 130. A ramped transition section may connect the inner radii of the upper and lower ends of the compression sleeve 130. As the compression sleeve 130 rotates and is driven into the connector body 110, the gap between the inside diameter of the compression sleeve 130 and the jacket 24 of the cable 10 is reduced and ultimately disappears as the upper end 132 of the compression sleeve (with the reduced circumference) is forced over the cable jacket 24. Thus, once the compression sleeve 130 is fully inserted and seated within the connector body 110, the compression sleeve 130 imparts a 360-degree compression force on the jacket 24. The horizontal grooves 138 may include one or more locking mechanisms that hold the compression sleeve 130 in place once it is fully seated within the connector body 110.

As noted above, the connectors according to embodiments of the present invention may be removed from a cable 10 and then subsequently used on another cable 10. With respect to the connector 100 of FIGS. 2, 3, 4, 5A-5C and 6, this removal step may be accomplished by twisting the compression sleeve 130 relative to the connector body 110 in order to disengage the compression sleeve 130 from the jacket 24 of cable 10. In certain embodiments of the present invention, the horizontal grooves 138 may include, for example, an inclined plane that reduces the amount of rotational force required to disengage the compression sleeve 130. Once the compression sleeve 130 is disengaged, the cable 10 may be removed from the connector 100, so that connector 100 may be reused on another cable 10.

Figure 16A:
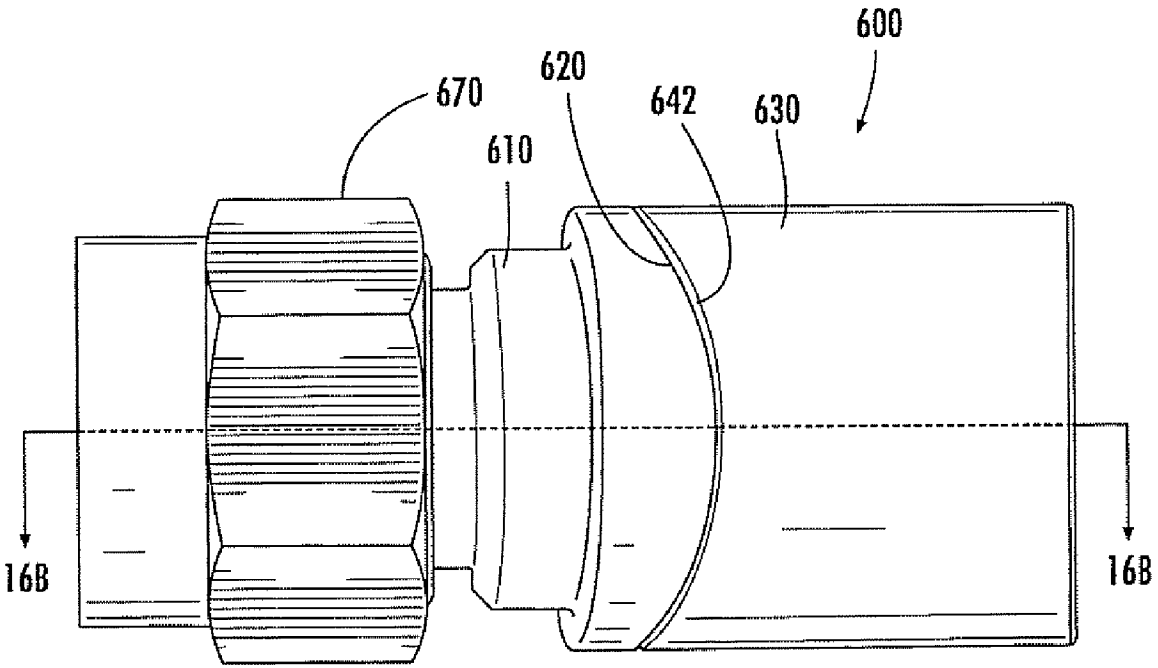
FIG. 16A is a side view of a coaxial "F" connector according to still further embodiments of the present invention.

In connector 100, the compression sleeve 130 inserts axially (and rotationally) into the inside diameter of the tubular connector body 110. However, it will be appreciated that, in other embodiments of the present invention, the compression sleeve 130 may be inserted axially (and rotationally) over the outside diameter of the connector body 110 so as to (1) directly impart a circumferential force on the inner contact post 150 or to (2) indirectly impart a circumferential force on the inner contact post 150 by imparting a compressive force on the connector body 110. Thus, it will be appreciated that all of the conventional compression-style back-fitting connector designs discussed above with respect to FIGS. 19-24 can be modified according to the teachings of the present invention to be reusable connectors. The same is also true with respect to each of the additional embodiments described herein. An example of an embodiment of the present invention that includes a compression sleeve that fits over the connector body is depicted in FIGS. 16A and B herein.

The coaxial cable 10 is generally prepared before a coaxial "F" connector is attached thereto. FIG. 1B depicts how the coaxial cable 10 may be prepared before the cable 10 is inserted into a coaxial "F" connector. As shown in FIG. 1B, end portions of the dielectric 14, the tape 16 that is preferably bonded to the dielectric 14, the electrical shielding wires 20, any electrical shielding tape 22 and the cable jacket 24 are cut away and removed so that the end portion of the central conductor 12 is fully exposed. Next, an additional end portion of the cable jacket 24 is removed. Then, the end portions of the electrical shielding wires/tape 20/22 are flared or folded back in whole or in part over the remainder of the cable 10.

The prepared cable 10 is then inserted into the connector 100. The exposed length of the central conductor 12 core is sufficient such that it will extend all the way through the connector and extend into the internally threaded nut portion of the connector as the male contact protrusion of the connector. As discussed above, the length of the compression sleeve 130 may be less than the length of the connector body 110. As a result, even when the compression sleeve 130 is fully inserted within the connector body 110, a gap will exist between the bottom 134 of the compression sleeve and the bottom 114 of the connector body 110. The flared or folded back portions of the electrical shielding wires 20 are forced into the well that is defined by this gap when the compression sleeve 130 is compressively forced into the connector body 110. The bottom 134 of the compressive sleeve 130 may exert an additional retention force on the electrical shielding wires 20 that fill this gap. This retention force may be increased even further by including additional serrations, teeth, lips or the like (not shown in the figures) on the bottom end 154 of the inner contact post 150 that are similar to the serrations provided on the top end 152 of the inner contact post 150. In addition, the flared/folded back portion of the electrical shielding wires 20 contacts the metal connector body 150, thereby advantageously grounding the electrical shielding wires 20.

Figure 7:
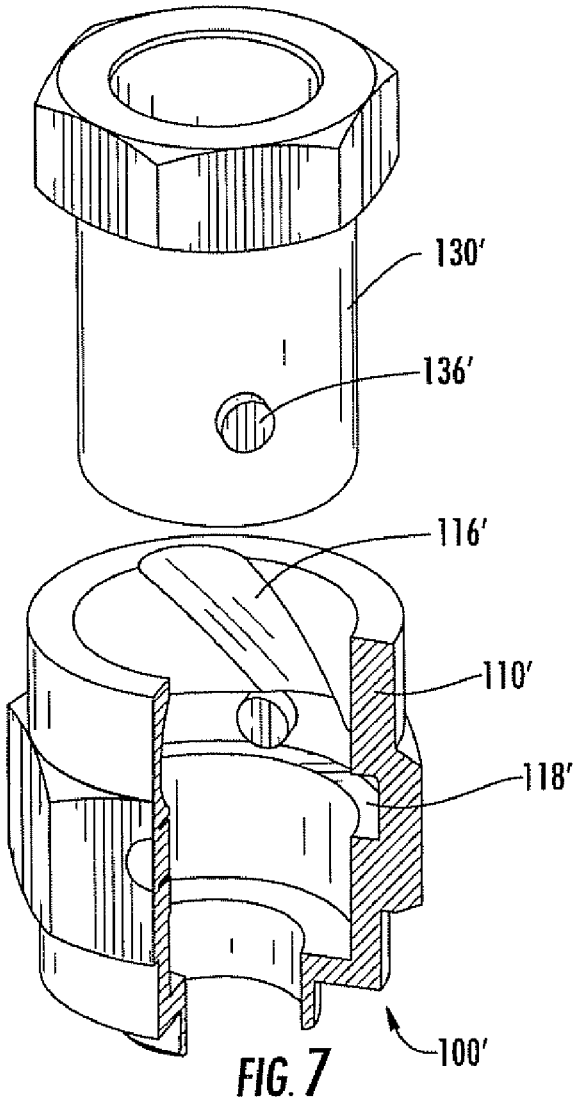
FIG. 7 is an exploded, partial cut-away perspective view of the connector body and compression sleeve of a coaxial "F" connector according to further embodiments of the present invention.

FIG. 7 is an exploded perspective view of the connector body 110' and the compression sleeve 130' of a connector 100' according to further embodiments of the present invention. As shown in FIG. 7, in the connector 100', the grooves 116', 118' are located in the interior surface of the connector body 110' (as opposed to on the compression sleeve), and the guide pins 136' are located on the outside surface of the compression body 130' (as opposed to on the inside surface of the connector body). The connector 100' may operate in substantially the same manner as the connector 100 operates. The primary difference between the two embodiments is the location of the grooves and the guide pins.

Figure 8A:
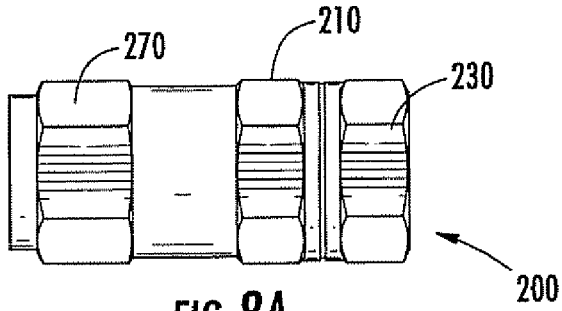
FIGS. 8A-8C are side views of a coaxial "F" connector according to still further embodiments of the present invention.
Figure 8B:
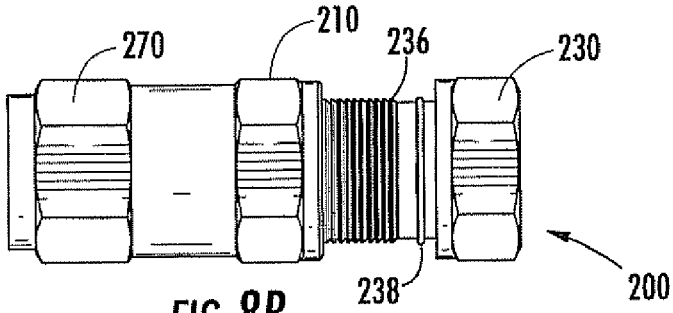
Figure 8C:
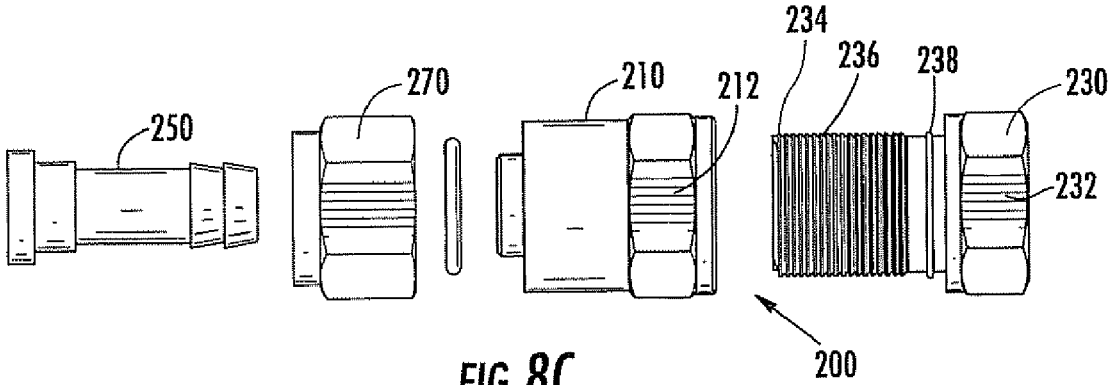
Figure 8D:
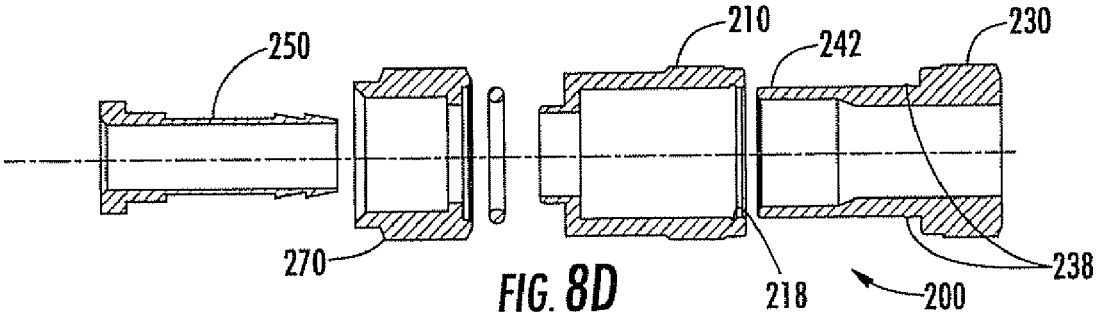
FIG. 8D is an exploded cross-sectional view of the connector of FIGS. 8A-8C.

FIGS. 8A-8C are side views of a connector 200 according to further embodiments of the present invention. FIG. 8D is an exploded cross-sectional view of the connector 200. As shown in, for example, FIG. 8C, the connector 200 includes a tubular connector body 210, a compression sleeve 230, an inner contact post 250 and an internally threaded nut 270. The inner contact post 250 and the internally threaded nut 270 may be identical to the inner contact post 150 and the internally threaded nut 170 discussed above with respect to FIGS. 2-6, and hence these components will not be described further here. The connector body 210 may be similar to the connector body 110 discussed above. However, the connector body 210 does not include the guide pins 116 that are provided on the connector body 110. Additionally, as shown in the cross-sectional view of FIG. 8D, an annular groove 218 is provided near the top end 212 of the connector body 210. The internal diameter of the connector body 210 also includes a plurality of female threads (not visible in the figures). These female threads will be described in more detail below.

As is also shown in FIGS. 8A-8D, the compression sleeve 230 is similar to the compression sleeve 130 of connector 100 that is described in detail above. However, the compression sleeve 230 includes a plurality of male threads 236 on a lower end 234 thereof. These male threads 236 are designed to mate with the female threads provided on the inside diameter of the connector body 210. The compression sleeve 230 further includes an annular ridge 238 that is located near the top end 232 of the compression sleeve 230. The ridge 238 has a larger diameter than the remainder of the lower portion 234 of compression sleeve 230. The annular ridge 238 is configured to be received within the annular groove 218 of connector body 210 when the connector 200 is attached to a cable 10. The seating of the annular ridge 238 in the annular groove 218 creates a retention force that acts to keep the compression sleeve 230 firmly seated within connector body 210. The retention force created by the seating of the annular ridge 238 in the annular groove 218 may also, in some embodiments, act to provide a watertight seal acting by itself or in combination with an added interstitial "O" ring.

The connector 200 may be attached to a cable 10 as follows. First, the cable 10 is prepared as discussed above with respect to the cable preparation methods that may be employed with the connector 100. Then, the prepared cable 10 is axially inserted into the compression sleeve 230. The core 18 of the cable 10 is axially inserted within the inner diameter of the inner contact post 250, and the electrical shielding wires/tape 20/22 and the cable jacket 24 are inserted over the outside diameter of the inner contact post 250. During this insertion process, the connector 200 may be in the assembly state shown in FIG. 8B. Next, a compression tool may be used to fully insert the compression sleeve 230 into the connector body 210 so that the connector 200 assumes the seated position of FIG. 8A. During this insertion process, the compression sleeve 230 may be driven into the connector body without rotation. As the male threads 236 on the compression sleeve 230 pass by the female threads in the connector body 210 each male thread 236 elastically "pops" into and out of each female thread that it passes. Note that the threads themselves and/or the sidewall of the compression sleeve 230 may elastically deform during this insertion process. The male and female threads may be designed to be somewhat "looser" than ordinary screw threads and may be somewhat flexible (e.g., plastic threads may be used) to facilitate driving the male threads 236 over the female threads during the insertion process without damaging either set of threads. The inner diameter of the upper end 232 of the compression sleeve 230 may have a smaller radius than the inner diameter of the lower end 234 of the compression sleeve 230. A ramped transition section may connect the inner radii of the upper and lower ends of the compression sleeve. As the compression sleeve 230 is driven into the connector body 210, the gap between the inside diameter of the compression sleeve 230 and the jacket 24 of the cable 10 is reduced and ultimately disappears as the upper end 232 of the compression sleeve (with the reduced circumference) is forced over the cable jacket 24. Thus, once the compression sleeve 230 is fully inserted and seated within the connector body 210, the compression sleeve 230 imparts a 360-degree compression force on the jacket 24. Once the compression sleeve 230 is fully inserted within the connector body 210, the annular ridge 238 snaps into the annular groove 218 in the connector body 210. The retention force exerted by the annular ridge 238 on the annular groove 218 facilitates holding the compression sleeve 230 within the connector body 210 and provides for a positive moisture seal by itself or in combination with an added interstitial "O" ring.

The compression sleeve 230 may be removed from the connector body 210 in order to remove the connector 200 from the cable 210 so that the connector 200 may be reused on another cable 10. This may be accomplished by reversibly rotating the compression sleeve 230. The male threads 236 of the compression sleeve turn within the female threads on the inside diameter of the connector body 210. The interlocked threads provide a mechanical advantage that, with a reasonably small amount of rotational force, is sufficient to disengage the prior compressive retention and sealing forces by "popping" the annular ridge 238 out of the annular groove 218 so that the compression sleeve may be backed out of the connector body to be in the unseated position of FIG. 8B. Once in the unseated position of FIG. 8B, the cable 10 may be removed from the connector 200. As no part of the connector 200 is excessively deformed or damaged by the above insertion and removal operations, the connector 200 may be reused on another cable 10.

While not shown in the drawings, one or both of the male threads 236 or the female threads on the inside surface of the connector body 210 may have one or more axial slots therein. Each slot may "cut through" some or all of the threads in a longitudinal direction. In an exemplary embodiment, four such slots are provided in the male threads of the compression sleeve, where adjacent slots are separated by approximately ninety degrees. These axial slots allow the threads to elastically deform radially when the compression sleeve 230 is driven into its seated position in the connector body 210, and thus may facilitate preventing excess wear or damage to the threads during the insertion process. Specifically, the slots allow the threads to elastically deform in such a way that the male threads may advance the female threads during the insertion process without excess permanent deformation of either set of threads.

Figure 9:
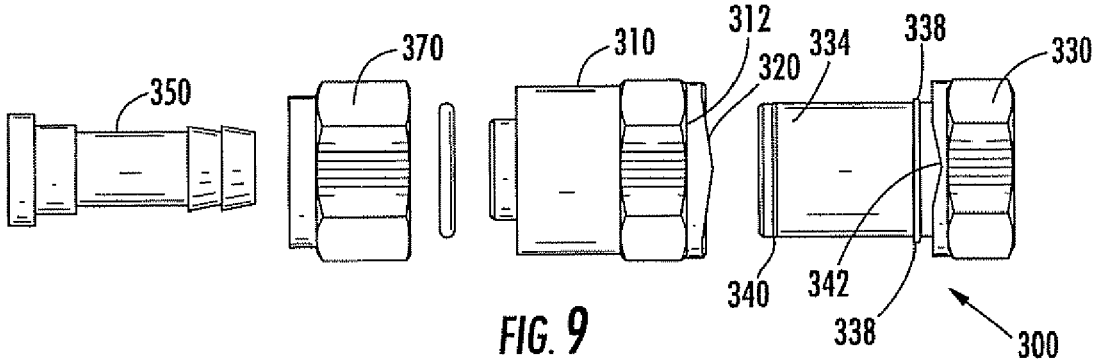
FIG. 9 is an exploded side view of a coaxial "F" connector according to yet further embodiments of the present invention.

FIG. 9 is an exploded side view of a coaxial "F" connector 300 according to yet further embodiments of the present invention. The connector 300 includes a tubular connector body 310, a compression sleeve 330, an inner contact post 350 and an internally threaded nut 370. The inner contact post 350 and the internally threaded nut 370 may be identical to the inner contact post 150 and the internally threaded nut 170 discussed above with respect to FIGS. 3-6, and hence these components will not be described further here. The compression sleeve 330 may be very similar to the compression sleeve 230 of FIGS. 8A-8D, except that the compression sleeve 330 does not include any male threads such as the threads 236 of compression sleeve 230. The connector body 310 may be similar to the connector body 210 discussed above, and includes an annular groove 318 (not visible in FIG. 9) that may be identical to the annular groove 218 of connector body 210. However, the connector body 310 does not include the female threads that are provided on the inside diameter of the connector body 210. Additionally, the compression sleeve 330 may include a second, lower annular ridge 340 that may be received within the annular groove 318 on the connector body. This second annular ridge 340 may facilitate shipping the coaxial connectors as a one piece unit as the seating of the annular ridge 340 in the annular groove 318 holds the compression sleeve 330 within the connector body 310. As the second annular ridge 340 is lower than the annular ridge 338, the second annular ridge 340 may be easily popped out of the annular groove 318 by a technician. Alternately, the mating interaction between the second annular ridge 340 and the annular groove 318 may be designed in a manner with sufficient retention forces such that they are not separable by hand, and hence are permanently assembled from the perspective of a field technician or installer.

Additionally, the top end 312 of the connector body 310 and/or the bottom portion of the nut adjacent the top end 332 of the compression sleeve 330 may be designed to have an inclined mating relationship with the other of the connector body 310 or compression sleeve 330 (see reference numerals 320 and 342 in FIG. 9). After the compression sleeve 330 has been inserted into the connector body 310, the inclined mating relationship may be used to obtain a mechanical advantage that may facilitate disengaging the compressive retention and sealing forces that bind the connector 300 onto the end of the cable 10. In particular, by rotating the compression sleeve 330 with respect to the connector body 310, the inclination of the mating parts assists in driving the compression sleeve 330 backward out of the connector body 310, thus allowing the cable 10 to be removed and the connector 300 to be reused.

Figure 10:
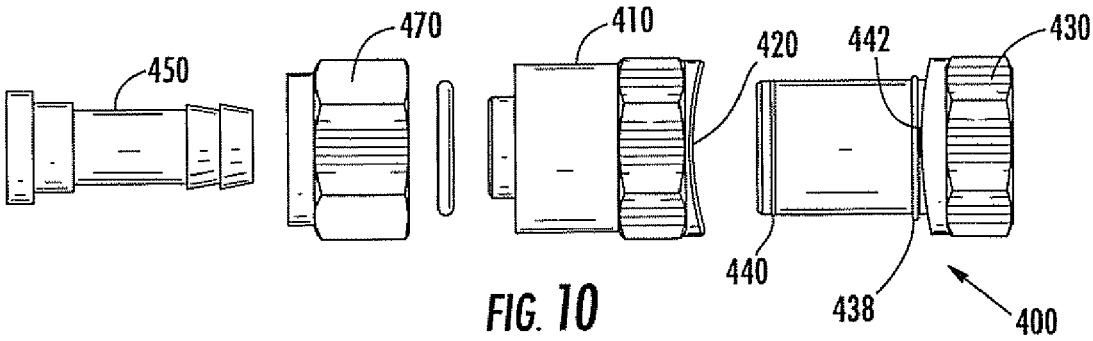
FIG. 10 is an exploded side view of a coaxial "F" connector according to additional embodiments of the present invention.

FIG. 10 is an exploded side view of a coaxial "F" connector 400 according to yet further embodiments of the present invention. The connector 400 includes a tubular connector body 410, a compression sleeve 430, an inner contact post 450 and an internally threaded nut 470. The inner contact post 450 and the internally threaded nut 470 may be identical to the inner contact post 150 and the internally threaded nut 170 discussed above with respect to FIGS. 3-6, and hence these components will not be described further here. The compression sleeve 430 may be very similar to the compression sleeve 330 of FIG. 9, except that the compression sleeve 430 does not include the inclined plane 342, and instead includes a cammed surface 442. The connector body 410 may be similar to the connector body 310 discussed above, except that the inclined plane 320 that is provided on the upper end of the connector body 310 is replaced with a cammed surface 420 on the connector body 410. After the compression sleeve 430 has been inserted into the connector body 410, the actions of the cams 420, 442 on each other may be used to obtain a mechanical advantage that may facilitate disengaging the compressive retention and sealing forces that bind the connector 400 onto the end of the cable 10. In particular, by rotating the compression sleeve 430 with respect to the connector body 410, the cam action assists in driving the compression sleeve 430 backward out of the connector body 410, thus allowing the cable 10 to be removed and the connector 400 to be reused.

Figure 11:
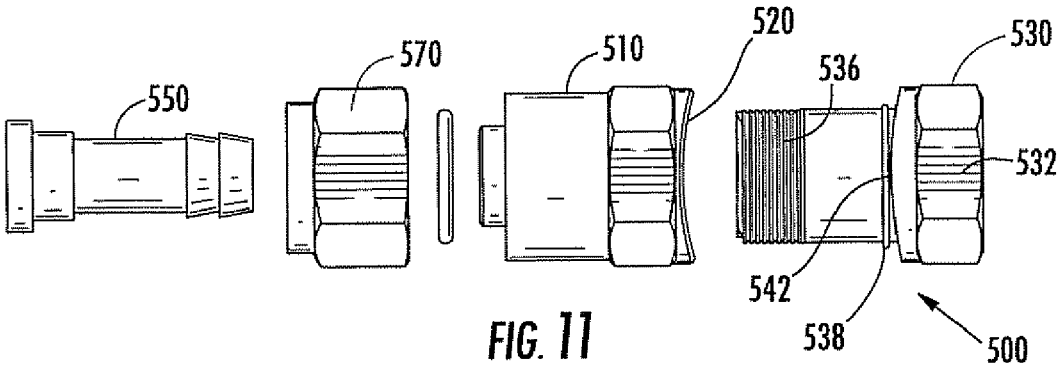
FIG. 11 is an exploded side view of a coaxial "F" connector according to further embodiments of the present invention.

FIG. 11 is an exploded side view of a coaxial "F" connector 500 according to yet further embodiments of the present invention. The connector 500 includes a tubular connector body 510, a compression sleeve 530, an inner contact post 550 and an internally threaded nut 570. The inner contact post 550 and the internally threaded nut 570 may be identical to the inner contact post 150 and the internally threaded nut 170 discussed above with respect to FIGS. 3-6, and hence these components will not be described further here. The compression sleeve 530 may be similar to the compression sleeve 230 of FIGS. 8A-8D, except that the threads 236 may not extend as far toward the top portion 532 of compression sleeve 530. In addition, the compression sleeve 530 further includes a cammed surface 542. The connector body 510 may be similar to the connector body 210 discussed above, except that it further includes a cammed surface 520 that may be similar or identical to the cammed surface 420 provided on the connector body 410 of FIG. 10. Thus, the coaxial connectors of FIG. 11 include at least two force multipliers, namely the mating threads and the mating cammed surfaces. The cammed surfaces may provide the majority of the force that is used to unseat the compression sleeve 530 from the connector body 510. The mating threads may provide the majority of the force that is used to further relieve the retention forces by way of a rotation of the compression sleeve 530 in a loosening direction relative to the connector body 510.

FIGS. 12-15 are an exploded perspective view, a cross-sectional view, a top view and a side view, respectively, of the connector 500 of FIG. 11. Operation of the connector 500 will be further explained with reference to these figures.

Figure 12:
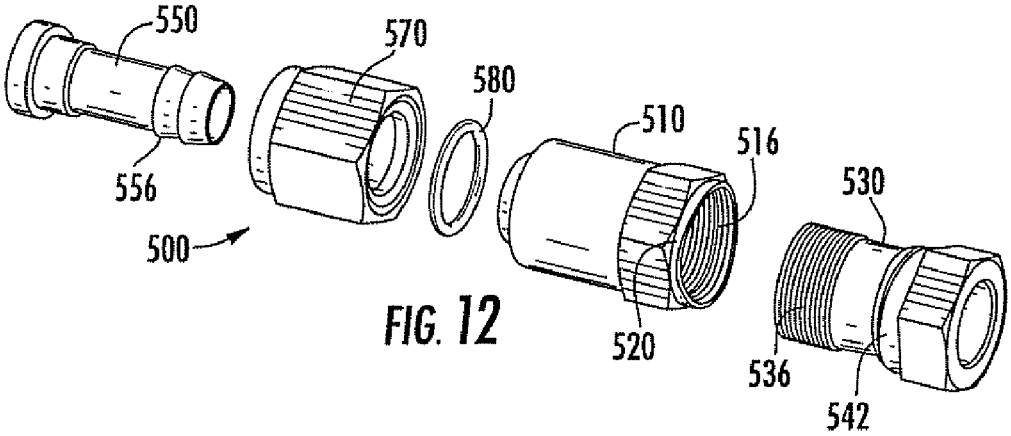
FIG. 12 is an exploded perspective view of the connector of FIG. 11.
Figure 13:
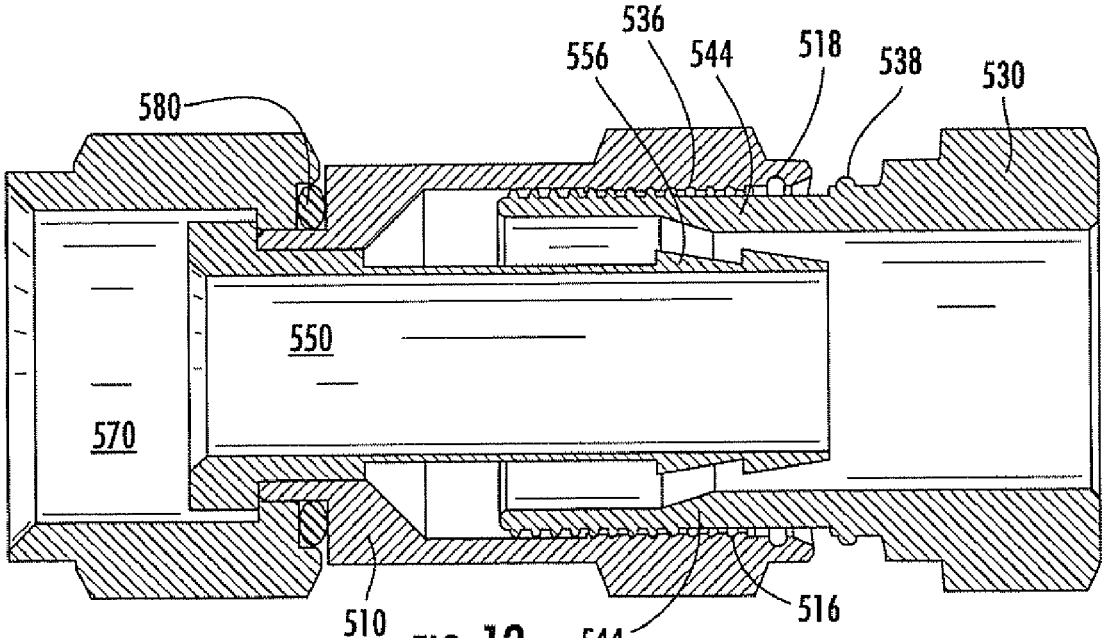
FIG. 13 is a cross-sectional view of the connector of FIG. 11.
Figure 14:
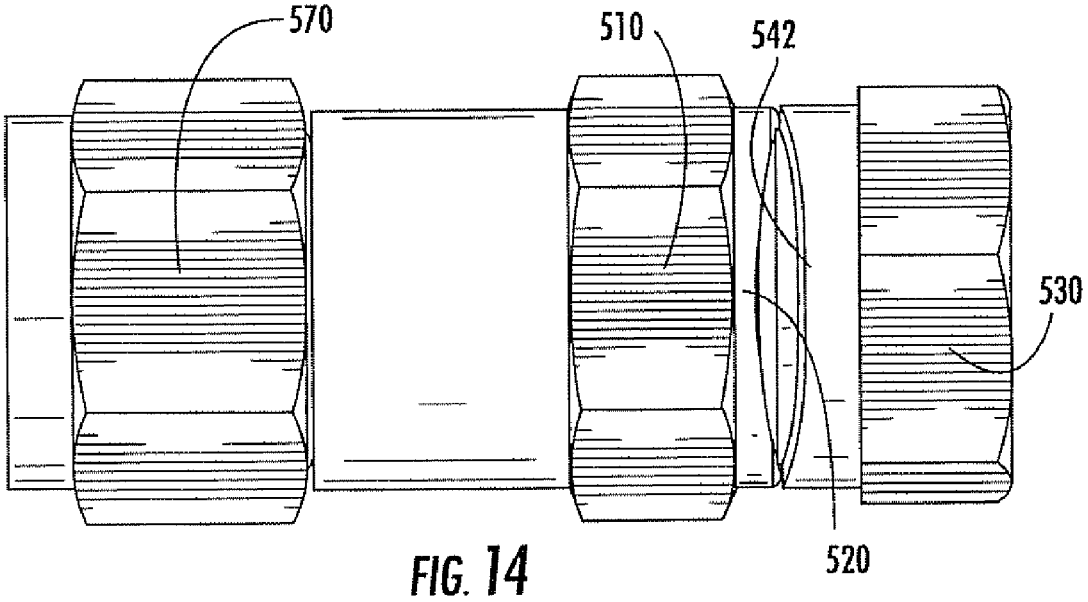
FIG. 14 is a top view of the connector of FIG. 11.
Figure 15:
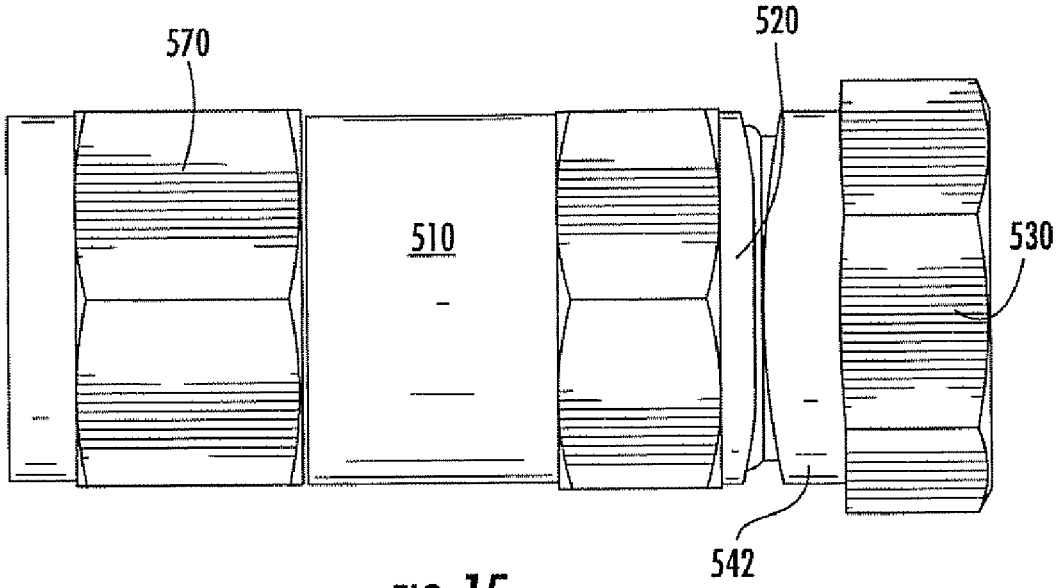
FIG. 15 is a side view of the connector of FIG. 11.

As shown in FIG. 12, the connector body 510 includes a plurality of female threads 516 on an inner surface thereof. These female threads 516 mate with the male threads 536 on compression sleeve 530. The mating of the male threads 536 and the female threads 516 is illustrated in the cross-sectional diagram of FIG. 13. FIG. 13 also shows the annular groove 518 on the connector body 510, and the annular ridge 538 on the compression sleeve 530. In FIG. 13, the compression sleeve has been backed slightly out of the seated position in which the annular ridge 538 is seated in the annular groove 518 by rotating the compression sleeve 530 by ninety degrees so that the cammed surfaces 520, 542 (see FIG. 12) facilitate popping the ridge 538 out of the groove 518. The cammed surfaces 520, 542 may be more clearly seen in FIGS. 14 and 15, which show the alignment of the cammed surfaces (top and side view) after the compression sleeve 530 has been rotated ninety degrees to pop the compression sleeve 530 out of its seated position.

FIG. 13 also shows a feature of the compression sleeve 530 that facilitates providing the retention force between the compression sleeve 530 and a cable 10. In particular, the inner surface of the compression sleeve 530 has a ramp 544 that reduces the radius of the inner surface at the middle and top end 532 of compression sleeve 530. The reduction in the inside radius of the compression sleeve is sufficient such that the outer components of the cable 10 are very tightly pressed between the inner contact post 550 and the portion of compression sleeve 530 having the reduced inner radius. In this manner, a strong retention force and moisture sealing may be provided. Such a ramped region may be provided in each of the compression sleeves discussed in the present application.

Figure 16B:
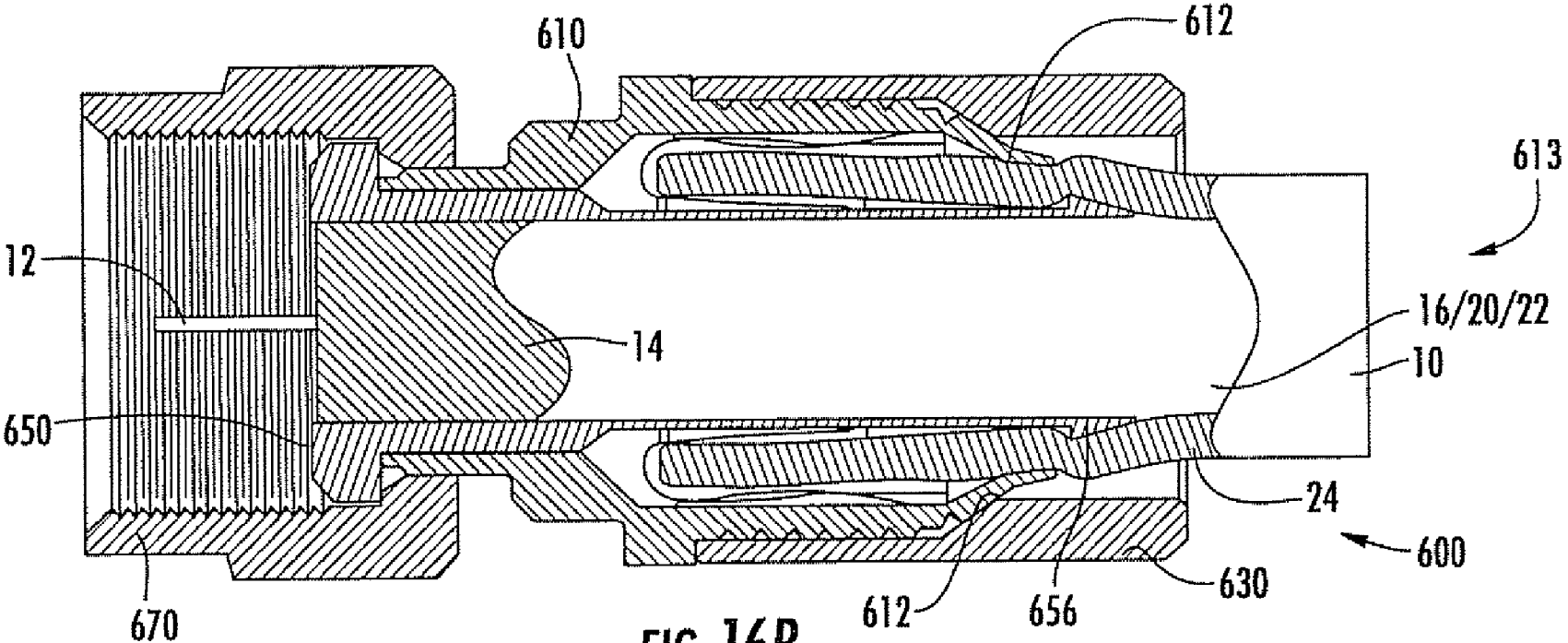
FIG. 16B is a side cross-sectional view of the coaxial "F" connector of FIG. 16A.

FIG. 16A is a side view of a coaxial "F" connector 600 according to still further embodiments of the present invention. FIG. 16B is a side cross-sectional view of the coaxial "F" connector 600. The connector 600 is similar to the connector 400 of FIG. 10, except that the connector 600 has an external compression sleeve 630 in contrast to the internal compression sleeve 430 of connector 400. As shown in FIGS. 16A and 16B, the connector 600 includes a tubular connector body 610, the external compression sleeve 630, an inner contact post 650 and an internally threaded nut 670. The inner contact post 650 and the internally threaded nut 670 may be identical to the inner contact post 450 and the internally threaded nut 470 discussed above with respect to connector 400, and hence these components will not be described further here. The compression sleeve 630 is similar to the compression sleeve 430 of FIG. 10, except that the compression sleeve 630 is an external compression sleeve that fits over the connector body 610, whereas compression sleeve 430 is an internal compression sleeve that fits inside the body 410 of connector 400. Likewise, the connector body 610 is similar to the connector body 410 of FIG. 10, except that the connector body 610 is configured to fit within the compression sleeve 630, whereas the connector body 410 is configured to fit outside compression sleeve 430.

As shown in FIG. 16B, a coaxial cable 10 may be inserted within the connector body 610 through an opening 613 in a rear portion 612 of connector body 610. The cable jacket 24 of coaxial cable 10 fits over the inner contact post 650, while the elements 14, 16, 20, 22 of core 18 of the cable is axially inserted within inner contact post 650. The rear portion 612 of connector body 610 is elastic or otherwise pliable. When the compression sleeve 630 is moved into its seated position, an axial force is exerted on the pliable rear portion 612 of connector body 610. In response to this axial force, the rear portion 612 of connector body 610 is forced inwardly into firm contact with the cable jacket 24 of coaxial cable 10, thereby locking the cable jacket 24 against the inner contact post 650.

As with the compression sleeve 430 of connector 400, the compression sleeve 630 may include a cammed surface 642 (see FIG. 16A). The connector body 610 also includes a cammed surface 620 (see FIG. 16A) that may be similar to the cammed surface 420 provided on the connector body 410 of FIG. 10. After the compression sleeve 630 has been inserted over the rear portion 612 of the connector body 610, the actions of the cams 620, 642 on each other may be used to obtain a mechanical advantage that may facilitate disengaging the compressive retention and sealing forces that bind the connector 600 onto the end of the cable 10. In particular, by rotating the compression sleeve 630 with respect to the connector body 610, the cam action assists in driving the connector body 610 out of the external compression sleeve 630, thus allowing the cable 10 to be removed and the connector 600 to be reused. It will be appreciated that, pursuant to further embodiments of the present invention, the cammed surfaces 620 and 642 of connector 600 may be replaced with inclined planes or threads in the same manner as shown above with respect to FIGS. 8A-8D (threads) and FIG. 9 (inclined planes). It will also be appreciated that the connector 600 could be modified to include a combination of threads and inclined planes or cammed surfaces.

Connectors according to embodiments of the present invention may also include alignment features that will facilitate aligning the compression sleeve and the connector body when the connector is reused. Typically, the compression sleeve and connector body will be pre-aligned at the time of manufacture so that they have the proper relationship with respect to each other for achieving the mechanical advantage that is provided, for example, by the cammed or inclined surfaces discussed above with respect to various embodiments of the present invention. However, after the reusable connectors of the present invention have been used one or more times and then removed from a coaxial cable, the compression sleeve and the connector body may no longer be properly aligned for achieving this mechanical advantage when the connector is to be reused by axially recompressing the compression sleeve back into the connector body. Pursuant to embodiments of the present invention, various alignment features may be provided that may facilitate re-aligning the compression sleeve and the connector body when the connector is to be reused on another coaxial cable.

Figure 17:
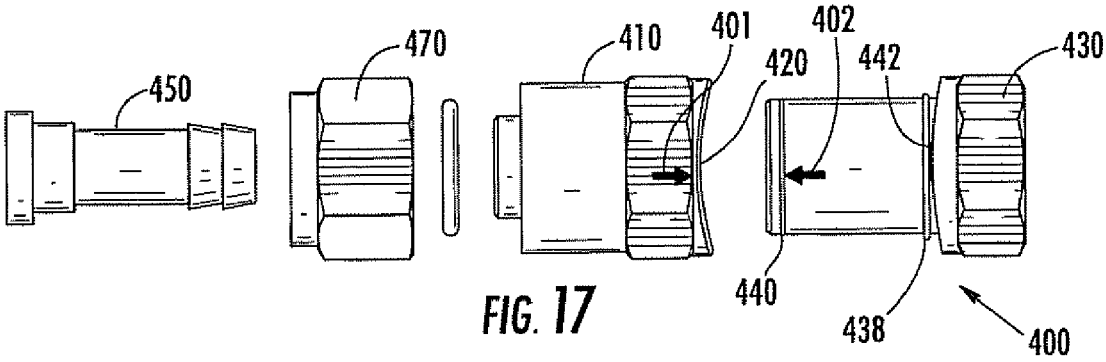
FIG. 17 depicts an alternative version of the connector of FIG. 10 that has been modified to include alignment arrows.

In some embodiments of the present invention, the alignment feature may comprise one or more arrows, hash marks, alignment marks/scores or other visible features that are, for example, printed on or molded or cut into either or both of the compression sleeve and the connector body. For example, alignment arrows could be provided on both the connector body and the compression sleeve that indicate the proper relative orientations of those components when the compression sleeve is rotated into its seated position on the connector body. FIG. 17 provides an example as to how alignment arrows 401, 402 could be provided on the connector 400 of FIG. 10 to implement this alignment feature.

Figure 18:
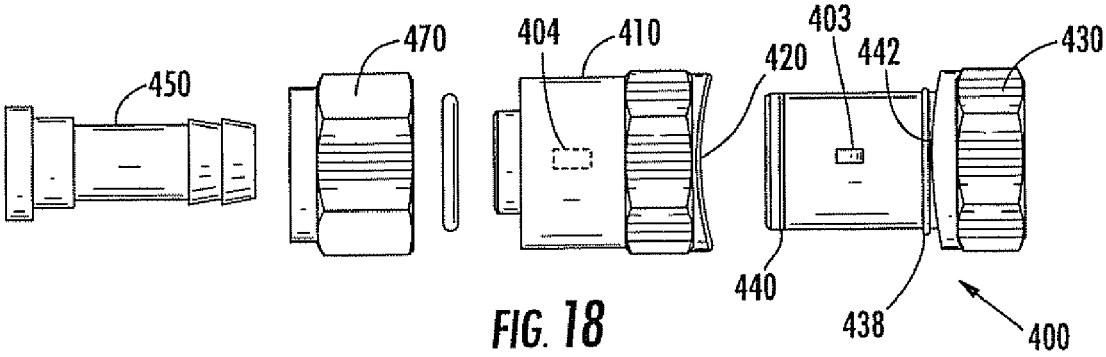
FIG. 18 depicts another alternative version of the connector of FIG. 10 that has been modified to include a mating protrusion and recess that facilitate aligning the connector body and compression sleeve.
Figure 19:
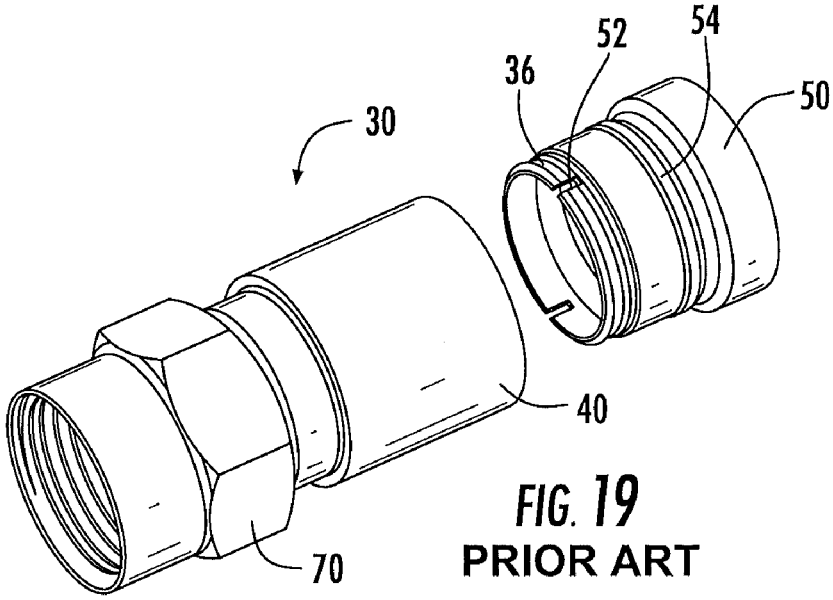
FIG. 19 PRIOR ART
FIG. 19 is a perspective view of a prior art coaxial "F" connector that has a compression style back fitting with the compression sleeve in a unseated position.
Figure 20:
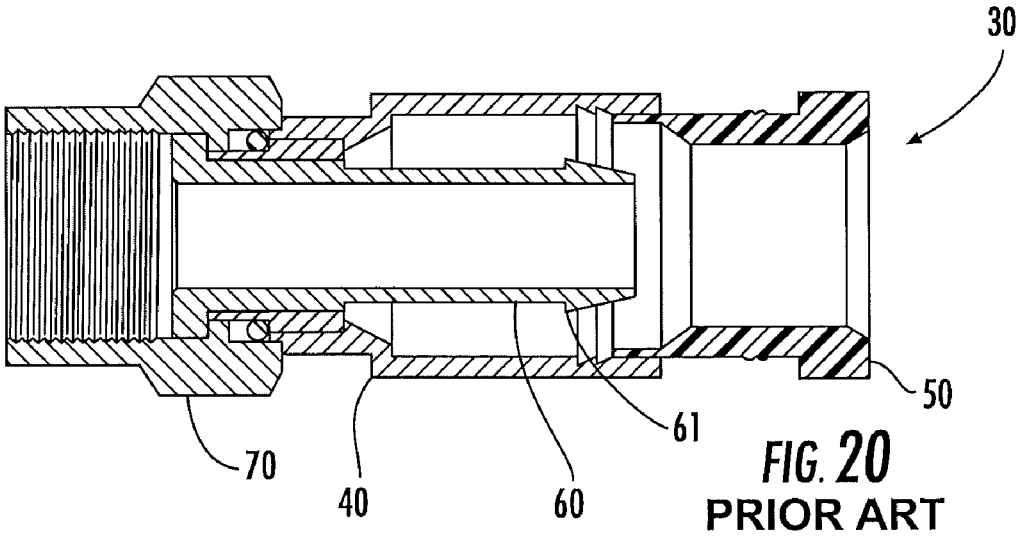
FIG. 20 PRIOR ART
FIG. 20 is a side cross-sectional view of the prior art coaxial "F" connector of FIG. 19.
Figure 21:
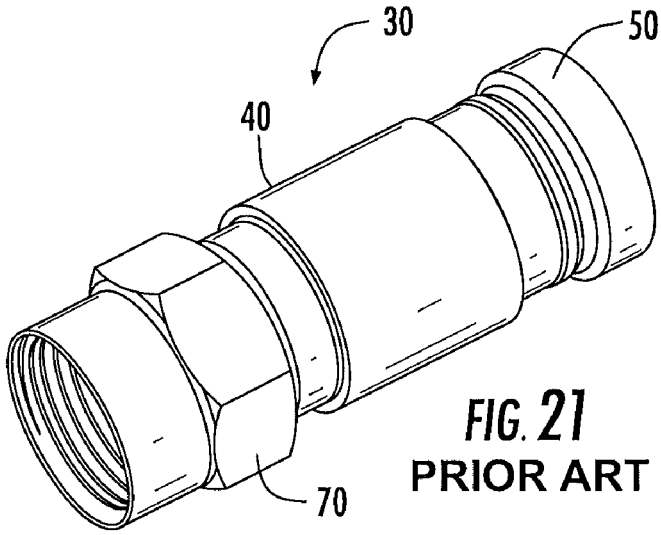
FIG. 21 PRIOR ART
FIG. 21 is a perspective view of the prior art coaxial "F" connector of FIG. 19 with the compression sleeve in a seated position.
Figure 22:
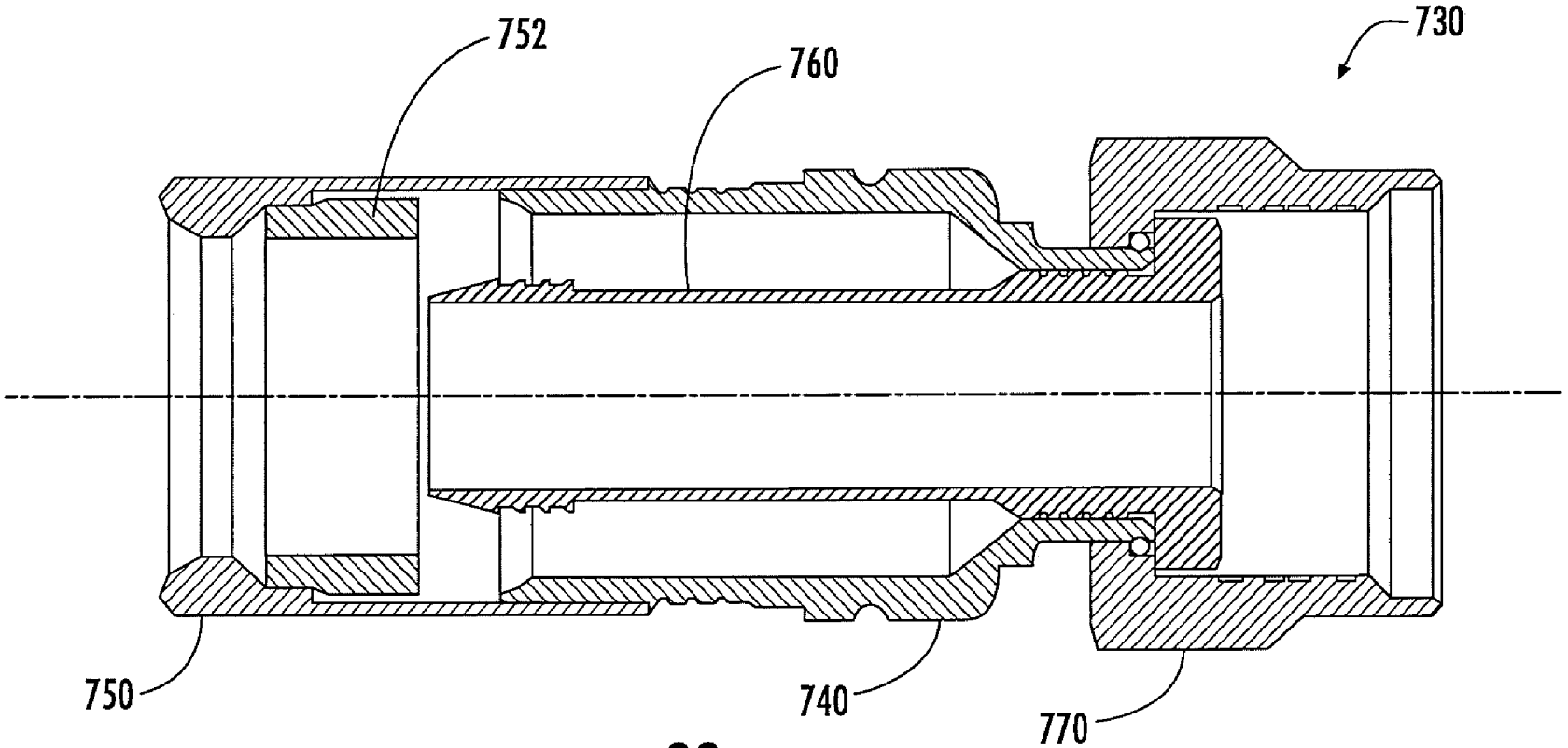
FIG. 22 PRIOR ART
FIG. 22 is a side cross-sectional view of another prior art coaxial "F" connector.
Figure 23:
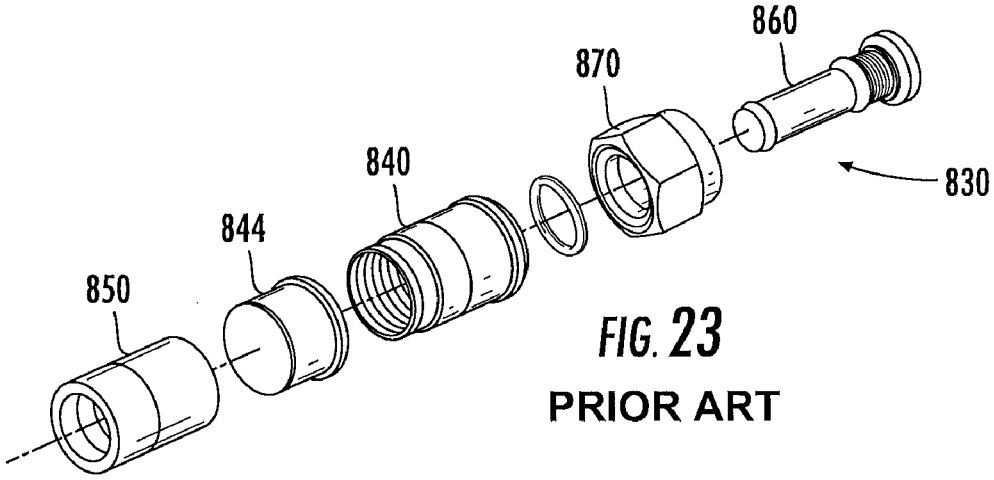
FIG. 23 PRIOR ART
FIG. 23 is an exploded perspective view of yet another prior art coaxial "F" connector that has a compression style back fitting.
Figure 24:
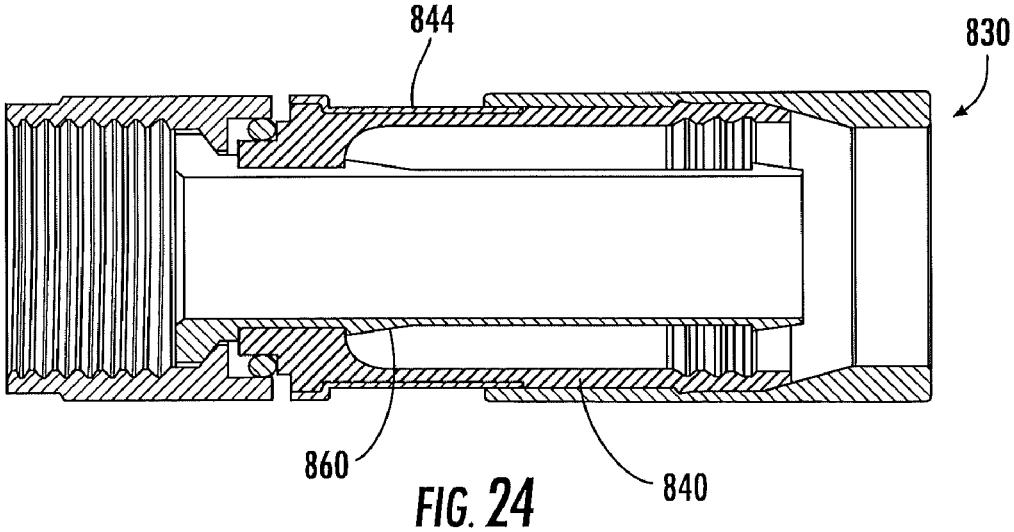
FIG. 24 PRIOR ART
FIG. 24 is a side cross-sectional view of the prior art coaxial "F" connector of FIG. 23.

It will also be appreciated that while alignment arrows or other visible indicia are one type of alignment feature that can be used in embodiments of the present invention, a wide variety of other alignment features may also be used. For example, in other embodiments of the present invention, the alignment feature could be one or more detents or other raised surfaces that are provided on, for example, the compression sleeve or the connector body that prevented relative rotation of those two components beyond a certain point. In other embodiments, one of the connector body or the compression sleeve could include a groove or recess while the other of the connector body or compression sleeve could include a detent or other raised protrusion that fits within the groove/recess when the two components are in proper alignment. Thus, an installer could rotate the compression sleeve and the connector body relative to each other until he or she hears and/or feels when the protrusion mates within the recess, indicating that proper alignment has been achieved. The mating raised surfaces/recesses may be designed to only apply a small retention force. FIG. 18 provides an example as to how a protrusion 403 could be provided on the connector 400 of FIG. 10 to implement this type of alignment feature. In FIG. 18, the mating recess 404 is shown by dashed lines since it is on the inside surface of connector body 410 and hence would not otherwise be visible in the particular view of FIG. 18. In still further embodiments, the alignment feature could be structures that increase or decrease the resistance when the connector body and compression sleeve are rotated relative to each other.

It will be appreciated that the connector bodies described herein may be any housing or body piece that receives an end of a coaxial cable that is to be attached to the connector. It will likewise be appreciated that the compression sleeves described herein may be implemented as any sleeve that is configured to be received within or over top of a connector body in order to impart a generally circumferential compressive force on an end of a coaxial cable that is received within the compression sleeve. The inner contact posts described herein may be any post or other structure within the connector that receives the coaxial cable either within and/or on the post.

While in embodiments of the present invention, the annular ridges 238, 338, 438, 538 are provided on the compression sleeve and the annular grooves 218, 318, 418, 518 are provided within the inside diameter of the connector body, it will be appreciated that in other embodiments the annular ridge may be provided on the inside body of the connector body and the annular groove may be provided on the compression sleeve. It will likewise be appreciated that retention mechanisms other than mating annular ridges and grooves may be used. For example, raised projections may be provided on one of the compression sleeve or the inside diameter of the connector body that mate with recesses on the other of the compression sleeve or the inside diameter of the connector body. It will be appreciated that many other retention mechanisms may be used.

It will be appreciated that many modifications may be made to the exemplary embodiments of the present invention described above without departing from the scope of the present invention. By way of example, while the above-described connectors include separate connector bodies and inner contact posts, it will be appreciated that in other embodiments the connector body and inner contact post of a coaxial connector can be implemented together as a one-piece unit that performs the above-described functions of the connector body and inner contact post. Thus, the present invention encompasses both one and multi-piece designs. It will likewise be appreciated that other components of the coaxial connectors described above may be combined into a single piece (e.g., the internally threaded nut and the connector body could be combined) and/or that some of the components may be implemented as multi-part components (e.g., the connector body may comprise multiple parts).

In some of the embodiments of the present invention that use a cam surface to provide a mechanical advantage for unseating the compression sleeve from the connector body, the cam surface may comprise a multi-profile cam surface. In particular, a first profile of the multi-cam surface may provide a high level of mechanical advantage over a small length of axial movement, while a second profile of the multi-cam surface may provide a lower level of mechanical advantage over a greater length of axial movement. The first profile may facilitate "popping" the above described annular ridge (or other retention mechanism) from the annular groove. The second profile may then assist in overcoming additional retention forces within the connector as the compression sleeve is moved from the fully seated position to a fully unseated position relative to the connector body. Likewise, in some of the embodiments of the present invention that use connector bodies and compression sleeves that mate in an inclined relationship to provide a mechanical advantage for unseating the compression sleeve from the connector body, the inclined relationship may be a multi-profile relationship that in a manner similar to the cam surface embodiments described above provide both a high level of mechanical advantage over a first, small length of axial movement and a lower level of mechanical advantage over a second, greater axial length of movement.

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. A reuseable coaxial connector, comprising:

a connector body;

an inner contact post that is at least partly within the connector body;

a compression element that is configured to impart a generally circumferential compressive force to secure one or more elements of a coaxial cable within the coaxial connector between the connector body and the inner contact post when the compression element is in a seated position;

a first disengagement mechanism that is configured to assist moving the compression element from the seated position to an unseated position in which at least some of the circumferential compressive force is eliminated so as to allow removal of the coaxial cable from within the coaxial connector, wherein the first disengagement mechanism comprises a first outer surface on the compression element and a second outer surface on the connector body; and wherein the first and second surfaces comprise a pair of mating cammed surfaces or a pair of surfaces in an inclined mating relationship.

2. The coaxial connector of claim 1, wherein at least one of the compression element and the connector body includes a second disengagement mechanism that is configured to operate independent of the first disengagement mechanism.

3. The coaxial connector of claim 2, wherein the first disengagement mechanism comprises a first surface on the connector body that is arranged in an inclined mating relationship with a second surface on the compression element.

4. The coaxial connector of claim 1, wherein at least one of the compression element and the connector body includes at least one raised projection and the other of the compression element and the connector body includes at least one mating recess that is configured to receive a respective one of the raised projection(s).

5. The coaxial connector of claim 4, wherein the at least one raised projection comprises an annular ridge and the at least one mating recess comprises an annular groove.

6. The coaxial connector of claim 5, wherein the annular ridge is configured to forcibly engage the annular groove when the compression element and connector body are fully seated together with a retention force that opposes axially reversing forces sufficient to meet SCTE requirements.

7. The coaxial connector of claim 5, wherein the annular ridge is configured to forcibly engage the annular groove when the compression element and connector body are fully seated together sufficiently to block water ingress.

8. The coaxial connector of claim 1, wherein the compression element is pre-mounted on the connector body in an extended, unseated position in which the connector is ready to receive a prepared end of the coaxial cable, and wherein the compression element is configured to be moved into the seated position by axially inserting the compression element into or over the connector body, thereby securing the end of the coaxial cable to the connector.

9. The coaxial connector of claim 1, wherein the compression element is configured to indirectly impart the compressive force on the coaxial cable that is attached to the connector when the compression element is in the seated position.

10. The coaxial connector of claim 1, wherein the connector body is at least partly within the compression element when the compression element is in the seated position.

11. The coaxial connector of claim 1, wherein at least one of the connector body and the compression element includes an alignment feature.

12. The coaxial connector of claim 11, wherein the alignment feature comprises a visual alignment indicia that specifies the proper alignment of connector body with respect to the compression element prior to moving the compression element into the seated position.

13. The coaxial connector of claim 11, wherein the alignment feature comprises a protrusion on one of the compression element or the connector body and a mating recess on the other of the compression element or the connector body, wherein the protrusion and recess are positioned so that the protrusion fits within the recess when the connector body is in proper alignment with the compression element for moving the compression element into the seated position.

14. A reuseable coaxial connector, comprising:

a connector body;

an inner contact post that is at least partly within the connector body;

a compression element that is configured to impart a generally circumferential compressive force to secure one or more elements of a coaxial cable within the coaxial connector between the connector body and the inner contact post when the compression element is in a seated position;

a first disengagement mechanism that is configured to assist moving the compression element from the seated position to an unseated position in which at least some of the circumferential compressive force is eliminated so as to allow removal of the coaxial cable from within the coaxial connector, wherein the first disengagement mechanism comprises a first generally concave surface on one of the connector body and the compression element and a second generally convex surface on the other of the connector body and the compression element, wherein the second generally convex surface projects in a direction that is generally parallel to a longitudinal axis of the connector body.

* * * * *